US008226350B2

(12) United States Patent
Hayashigaito et al.

(10) Patent No.: US 8,226,350 B2
(45) Date of Patent: Jul. 24, 2012

(54) FAN APPARATUS

(75) Inventors: Tomo Hayashigaito, Kyoto (JP); Kenji Iwamoto, Kyoto (JP); Yoshihisa Kato, Kyoto (JP); Hironobu Nishida, Kyoto (JP); Suguru Yamada, Kyoto (JP); Manabu Miyakoda, Kyoto (JP)

(73) Assignee: Nidec Corporation, Kyoto (JP)

( * ) Notice: Subject to any disclaimer, the term of this patent is extended or adjusted under 35 U.S.C. 154(b) by 1134 days.

(21) Appl. No.: 12/103,918

(22) Filed: Apr. 16, 2008

(65) Prior Publication Data

US 2008/0260517 A1 Oct. 23, 2008

(51) Int. Cl.
*F04D 29/54* (2006.01)

(52) U.S. Cl. ..... 415/66; 415/211.2; 415/220

(58) Field of Classification Search ..... 415/60, 415/66, 199.4, 220, 223; 416/120, 124, 125, 416/128

See application file for complete search history.

(56) References Cited

U.S. PATENT DOCUMENTS

| | | | | |
|---|---|---|---|---|
| 5,546,272 | A | 8/1996 | Moss et al. | |
| 6,464,578 | B1 * | 10/2002 | Chin et al. | 454/184 |
| 6,538,888 | B1 * | 3/2003 | Wei et al. | 361/697 |
| 6,587,335 | B1 * | 7/2003 | Nelson et al. | 361/679.49 |
| 6,643,131 | B1 * | 11/2003 | Huang | 361/697 |
| 6,731,502 | B1 * | 5/2004 | Hsu | 361/695 |
| 6,779,975 | B2 * | 8/2004 | Takashima et al. | 415/213.1 |
| 6,920,049 | B2 | 7/2005 | Brooks et al. | |
| 2004/0076517 | A1 * | 4/2004 | Matsumoto et al. | 415/220 |
| 2004/0265123 | A1 * | 12/2004 | Chang et al. | 415/211.2 |
| 2006/0023419 | A1 * | 2/2006 | Kao et al. | 361/690 |
| 2006/0237453 | A1 | 10/2006 | Yu et al. | |
| 2007/0081888 | A1 | 4/2007 | Harrison | |
| 2007/0286722 | A1 * | 12/2007 | Lan | 415/200 |

FOREIGN PATENT DOCUMENTS

| | | | |
|---|---|---|---|
| JP | 2006-301763 | A | 11/2006 |
| JP | 2007-247501 | A | 9/2007 |
| JP | 4033843 | B2 | 11/2007 |

OTHER PUBLICATIONS

Yamada et al.: "FAN APPARATUS," U.S. Appl. No. 12/186,041, filed on Aug. 5, 2008.

* cited by examiner

*Primary Examiner* — Richard Edgar
(74) *Attorney, Agent, or Firm* — Keating & Bennett, LLP

(57) ABSTRACT

A fan apparatus includes a casing and a fan unit. The casing is a hollow member having an inlet and an outlet. The fan unit has an inlet and an outlet, and includes a plurality of axial fans. The fan unit is disposed on the inside of the casing, and the inlet of the fan unit is disposed in the vicinity of the inlet of the casing. The position of the fan unit within the casing can be varied in order to alter the air flow and static pressure of the air discharged by the fan apparatus.

20 Claims, 12 Drawing Sheets

FAN APPARATUS

BACKGROUND OF THE INVENTION

1. Field of the Invention

The present invention relates to a fan apparatus, and particularly to a fan apparatus including a fan unit and a casing in which the fan unit is disposed.

2. Description of the Related Art

As one type of server, there is a blade server. The blade server is a computer system provided with one or more circuit boards called server blades. The server blades include electronic components such as an MPU (Micro Processing Unit), a memory, and/or a hard disk mounted thereon.

Each server blade is included in a chassis. The chassis is arranged in a rack cabinet. An example in which server blades are disposed in a chassis is shown in JP-A-2004-240967, for example.

In the blade server, electronic components are mounted in a high-density fashion, and a large amount of heat is generated by these electronic components. The heat that is generated by the components is likely to remain in the chassis. In order to radiate the heat from the interior of the chassis to the exterior of the chassis, the blade server is provided with a fan. Using this fan, hot air in the blade server is circulated to the outside, thereby cooling the electronic components disposed in the blade server.

Generally, a fan requires a large air flow and high static pressure in order to properly discharge air. A fan to be included in a blade server must be capable of discharging air with a large air flow and high static pressure. One type of fan that discharges air with a large air flow and high static pressure is a fan unit that includes a plurality of axial fans.

In some cases, a duct and a casing are attached to the fan. Using this configuration, the air discharged by the fan can be guided to various locations in the blade server. However, depending upon the configuration and structure of the duct, the casing, and the fan unit, the cooling properties of a fan apparatus provided by the duct, the casing, and the fan unit will vary. Accordingly, specific configurations and structures of the duct, the casing, and the fan unit are necessary to improve the cooling properties of the fan apparatus.

SUMMARY OF THE INVENTION

A fan apparatus according to a preferred embodiment of the present invention includes a casing and a fan unit. The casing is a hollow member having an inlet and an outlet. The fan unit is defined by a plurality of axial fans. The fan unit has an inlet and an outlet. The fan unit is disposed on an inside of the casing. The inlet of the fan unit is positioned in the vicinity of the inlet of the casing.

In another preferred embodiment, the fan unit may include at least one first axial fan and at least one second axial fan. The first axial fan preferably includes a first impeller, a first motor portion, a first base portion, a first housing, and a plurality of first supporting ribs. The first impeller has a plurality of first vanes that are rotatable about a center axis. The first motor portion drives and rotates the first impeller. The first base portion supports the first motor portion. The first housing has a first inlet and a first outlet. The first housing is a hollow member that encloses the first impeller, the first motor portion, and the first supporting ribs. The first supporting ribs couple an inner side surface of the first housing to the first base portion. The second axial fan preferably includes a second impeller, a second motor portion, a second base portion, a second housing, and a plurality of second supporting ribs.

The second impeller has a plurality of second vanes that are rotatable about the center axis. The second motor portion drives and rotates the second impeller. The second base portion supports the second motor portion. The second housing has a second inlet and a second outlet. The second housing is a hollow member for enclosing the second impeller, the second motor portion, and the second supporting ribs. The second supporting ribs couple an inner side surface of the second housing to the second base portion. The first outlet of the first housing is preferably aligned with the second inlet of the second housing in the direction along the center axis. In addition, the inlet of the fan unit functions as the first inlet of the first housing.

With the above-described configuration, the air discharged by the fan apparatus can be substantially straightened, so that the air flow and the static pressure can be increased.

Other features, element, advantages and characteristics of the present invention will become more apparent from the following detailed description of preferred embodiments thereof with reference to the attached drawings.

DETAILED DESCRIPTION OF PREFERRED EMBODIMENTS

Figure 1:
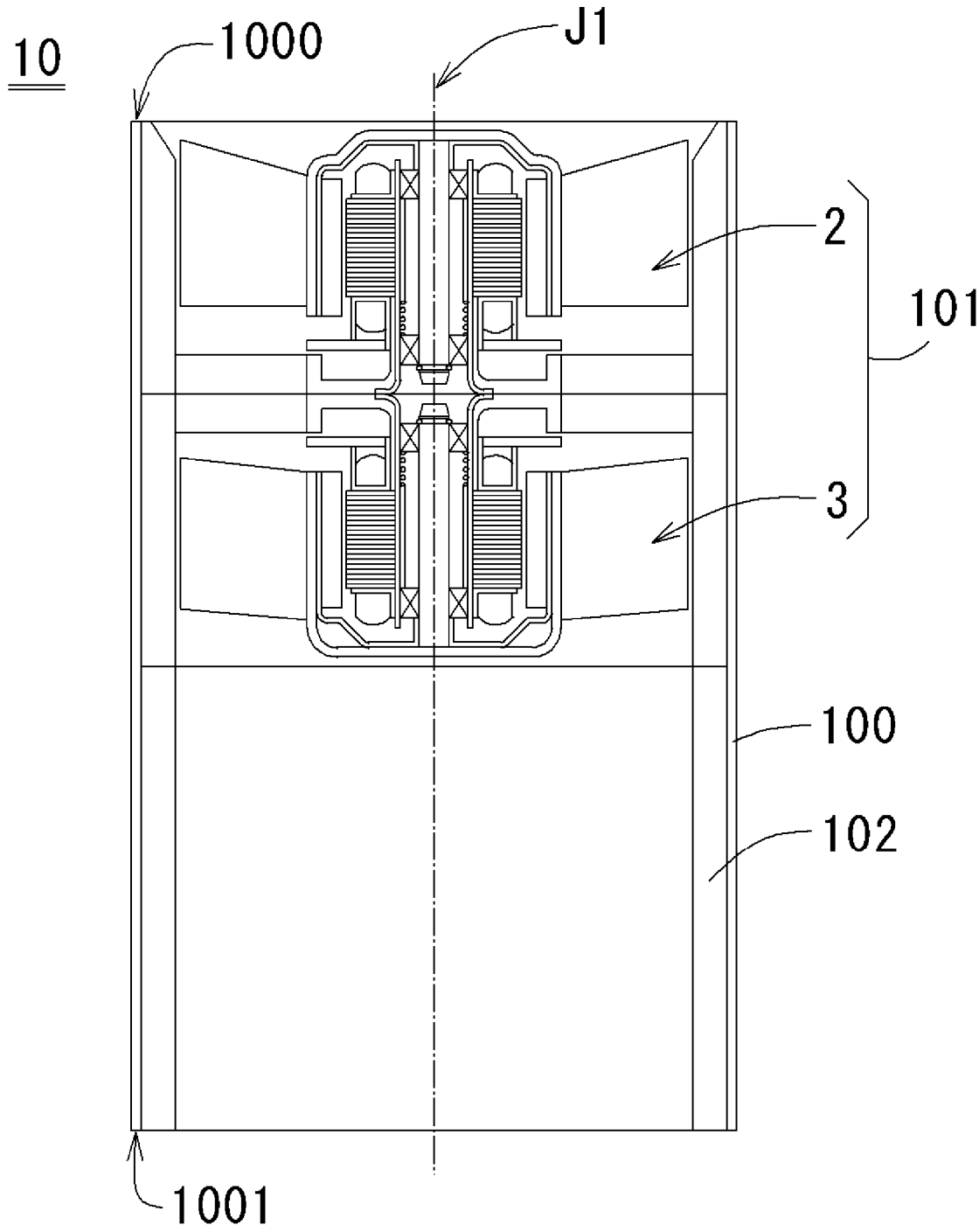
FIG. 1 is a sectional view showing a fan apparatus according to a first preferred embodiment of the present invention.

Referring to FIGS. 1 through 12, preferred embodiments of the present invention will be described in detail. It should be noted that in the explanation of the preferred embodiments of the present invention, when positional relationships and orientations of the different components are described as being up/down or left/right, ultimately positional relationships and orientations that are in the drawings are indicated. Positional relationships and orientations of the components after they have been assembled into an actual device are not indicated. In the following description, an axial direction indicates a direction substantially parallel to a rotation axis, and a radial direction indicates a direction substantially perpendicular to the rotation axis.

Figure 2:
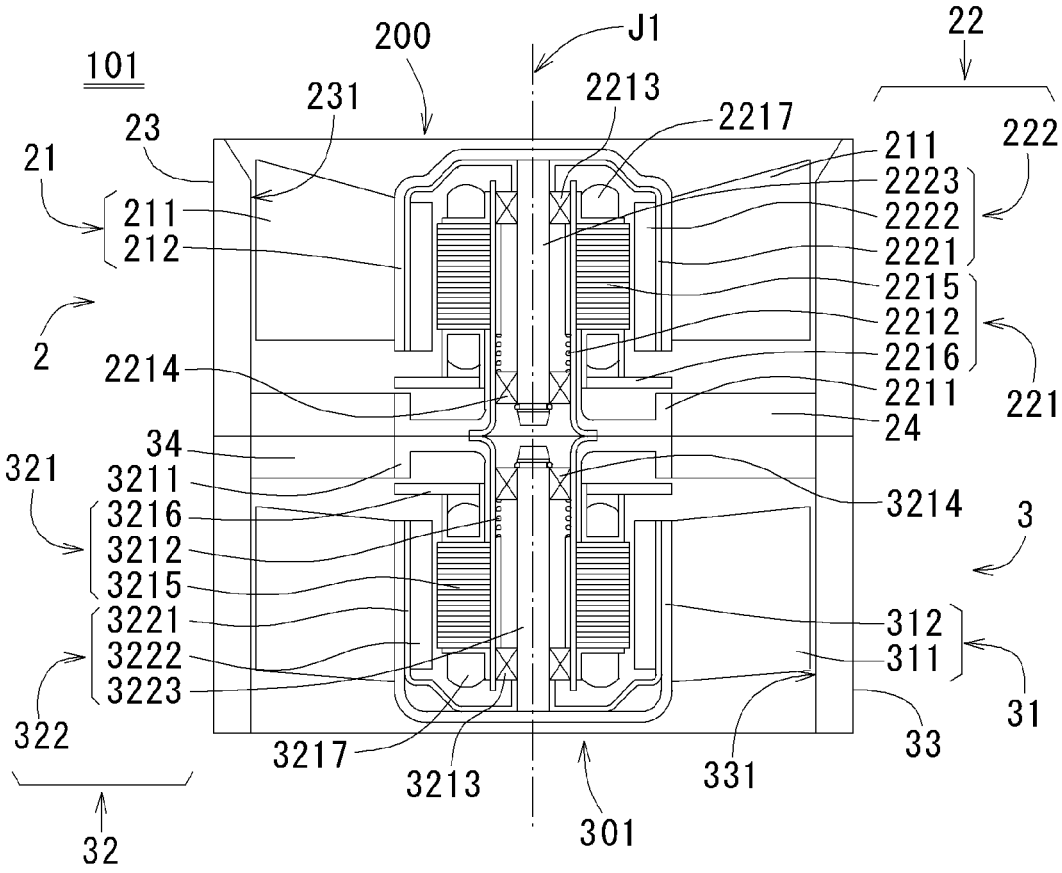
FIG. 2 is a sectional view showing an axial fan in the first preferred embodiment of the present invention.
Figure 3:
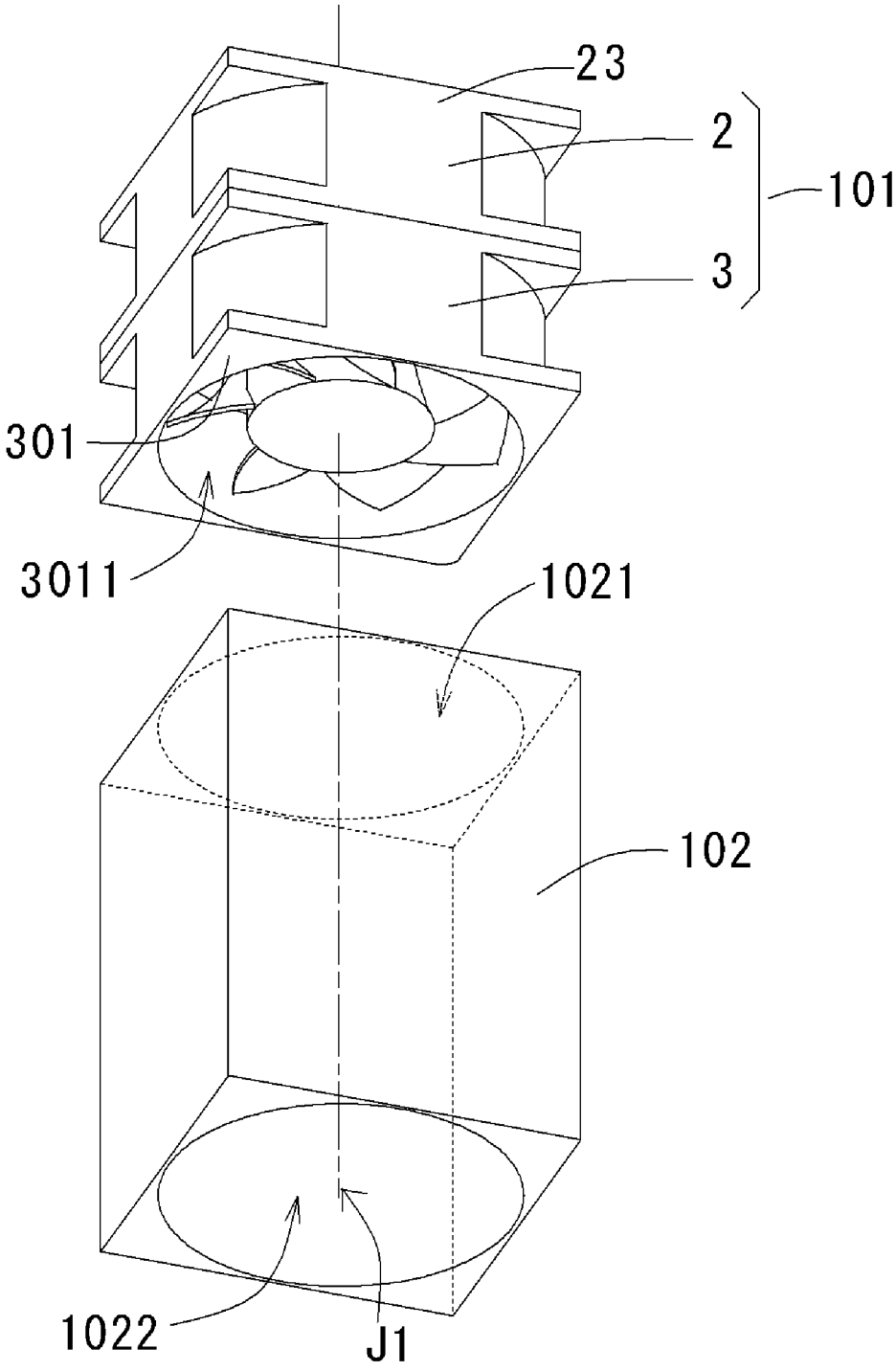
FIG. 3 is a perspective view showing a fan unit and a duct in the first preferred embodiment of the present invention.
Figure 4:
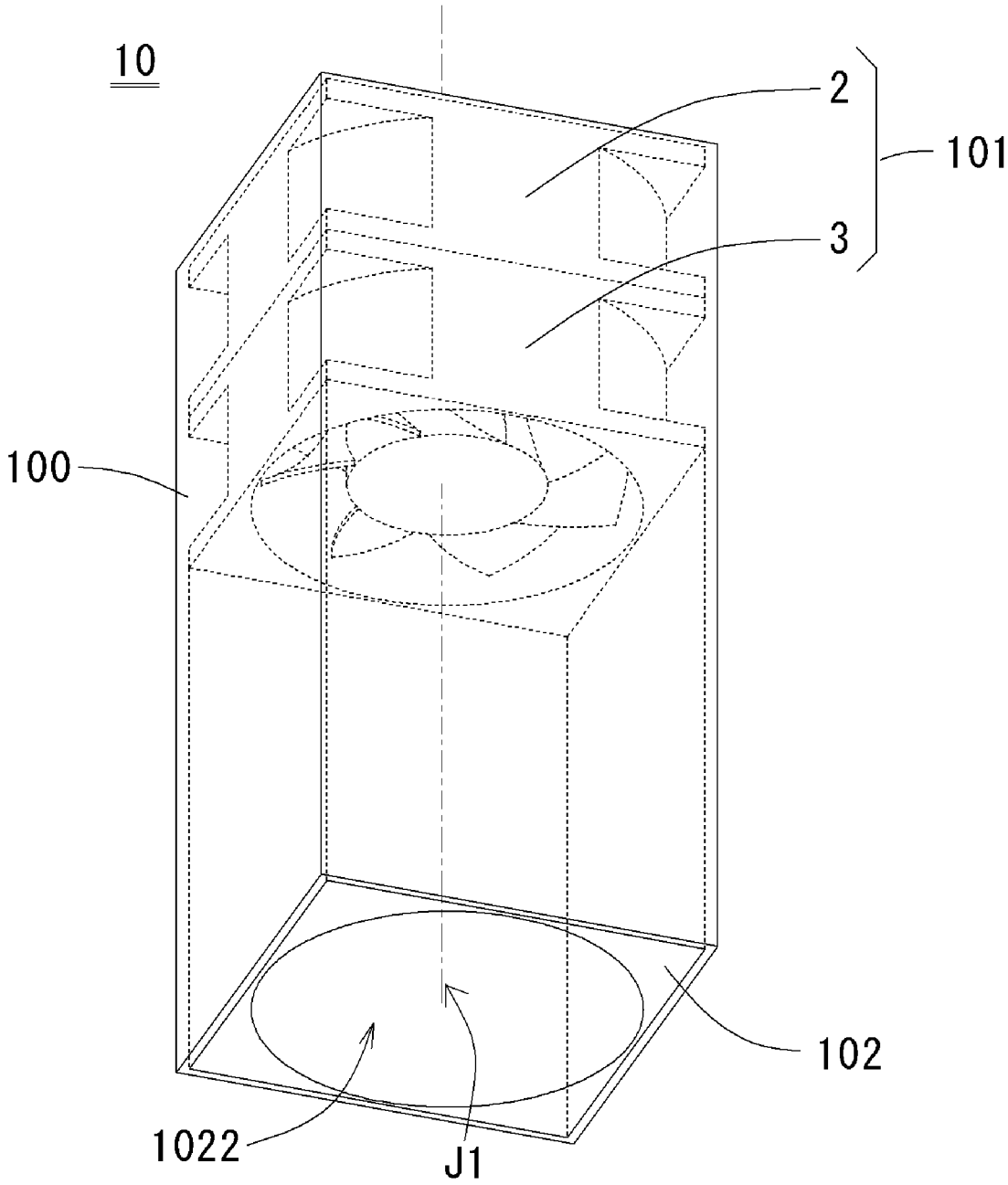
FIG. 4 is a perspective view showing the fan apparatus of the first preferred embodiment of the present invention.

First, the configuration of a fan apparatus 10 of the first preferred embodiment of the present invention will be described. FIG. 1 is a sectional view showing the fan apparatus of the first preferred embodiment of the present invention. FIG. 2 is a sectional view of an axial fan of the first preferred embodiment of the present invention. FIG. 3 is a perspective view showing a fan unit and a duct in the fan apparatus in the first preferred embodiment of the present invention. FIG. 4 is a perspective view of the fan apparatus of the first preferred embodiment of the present invention.

As shown in FIGS. 1 and 4, the fan apparatus 10 includes a casing 100, a fan unit 101, and a duct 102. As shown in FIGS. 1 and 4, the fan unit 101 and the duct 102 are disposed along a center axis J1 in the inside of the casing 100. In the fan unit 101, air is drawn in from the upper side, directed down along the center axis J1 as seen in FIG. 1, and then discharged toward the lower side along the center axis J1. The duct 102 is disposed on the discharging side of the fan unit 101 (i.e., on the lower side in the direction along the center axis J1 in FIG. 1).

In the following description, the side from which the air is drawn in is referred to as "an inlet side" or "an upper side", and the side from which the air is discharged is referred to as "an outlet side", or "a lower side". However, these directions do not necessarily coincide with the direction of gravity.

As shown in FIGS. 1 and 4, the casing 100 is preferably a hollow metallic member having a through hole extending in a direction along the center axis J1. In end portions of the casing 100 on the upper and lower sides in the direction along the center axis J1, an inlet-side opening 1000 and an outlet-side opening 1001 are defined, respectively. When viewed from the direction along the center axis J1, the outer shape of the casing 1000 is substantially rectangular. The shapes of the inlet-side opening 1000 and the outlet-side opening 1001 of the casing 100 are substantially circular. When viewed from the direction along the center axis J1, the shape of the interior of the casing 100 is substantially rectangular.

The casing 100 is preferably formed to have the above-described shape by pressing a thin metal plate. The material and the production method for the casing 100 are not specifically limited to the above described method. For example, the casing 100 may be produced by injection molding with a resin or plastic, or by any other suitable method and material.

Next, the fan unit 101 will be described. As shown in FIG. 2, the fan unit 101 includes a first axial fan 2 and a second axial fan 3. The first axial fan 2 and the second axial fan 3 have substantially the same configuration.

As shown in FIG. 2, the first axial fan 2 preferably includes a first impeller 21, a first motor portion 22, a first housing 23, and a plurality of first supporting ribs 24.

The first housing 23 is a hollow member having a through hole extending in a direction along the center axis J1. When viewed from the direction along the center axis J1, the outer shape of the first housing 23 is substantially rectangular, and the inner shape thereof is substantially circular. As shown in FIG. 1, when the fan unit 101 is to be assembled in the inside of the casing 100, an outer side surface of the first housing 23 abuts against the inner side surface of the casing 100 substantially without any gaps. As shown in FIG. 2, the first impeller 21, the first motor portion 22, and the first supporting ribs 24 are arranged in the inside of the first housing 23.

As shown in FIG. 2, the first impeller 21 includes a first hub 212 having a covered and substantially cylindrical shape, and a plurality of first vanes 211. The plurality of first vanes 211 extend radially outwards from an outer circumferential surface of the first hub 212. The first vanes 211 are disposed at regular pitches in a circumferential direction with the center axis J1 as the center on the outer circumferential surface of the first hub 212. The first hub 212 and the first vanes 211 are preferably integrally formed by injection molding with a resin or a plastic. The first impeller 21 is driven by the first motor portion 22 so as to rotate around the center axis J1.

The first motor portion 22 includes a first stator portion 221 and a first rotor portion 222. The first rotor portion 222 rotates around the center axis J1 in a manner relative to the first stator portion 221.

The first rotor portion 222 includes a first yoke 2221, a first field magnet 2222, and a first shaft 2223.

The first yoke 2221 is made from a magnetic metal material. The first yoke 2221 has a cupped and substantially cylindrical shape. The first yoke 2221 is fixed to the inside of the first hub 212 of the first impeller 21 by adhesive, press fitting, or the like. In a center of a cover portion of the first yoke 2221, a cylindrical portion extends downwards in the direction along the center axis J1. In the cylindrical portion, a through hole extends in the direction along the center axis J1.

The first field magnet 2222 is substantially annular. An outer circumferential surface of the first field magnet 2222 is held by an inner circumferential surface of the first yoke 2221 by press fitting, an adhesive, or the like.

The first shaft 2223 is defined by a substantially rod-like shape. An end portion of the first shaft 2223 on the upper side in the direction along the center axis J1 is fixed to and held by the through hole in the cylindrical portion of the cover portion of the first yoke 2221 by press fitting, and adhesive, or the like.

As shown in FIG. 2, the first stator portion 221 includes a first base portion 2211, a first bearing holding portion 2212, ball bearings 2213 and 2214, a first armature 2215, a first circuit board 2216, and a first coil 2217.

The first base portion 2211 includes a bottom portion and has a substantially cylindrical shape arranged with the center axis J1 as its center. In a center portion of the bottom portion of the first base portion 2211, an opening extending in the direction along the center axis J1 is provided. The first base portion 2211 holds respective portions of the first stator portion 221. The first supporting ribs 24 extend from an inner circumferential surface 231 of the first housing 23, and are connected to an outer circumferential surface of the first base portion 2211. The first supporting ribs 24 are disposed at regular pitches in the circumferential direction with the center axis J1 as the center in a radial space between the first base portion 2211 and the inner circumferential surface 231 of the first housing 23. The first housing 23, the first base portion 2211, and the first supporting ribs 24 are preferably integrally formed by injection molding with a resin or a plastic. Alternatively, the first housing 23, the first base portion 2211, and the first supporting ribs 24 may be integrally formed by aluminum die-casting.

As shown in FIG. 2, the first bearing holding portion 2212 is positioned in the approximate center portion of the bottom portion of the first base portion 2211. An end portion of the first bearing holding portion 2212 on the lower side in the direction along the center axis J1 is fixed in the opening in the center portion of the bottom portion of the first base portion 2211.

The ball bearings 2213 and 2214 are attached on the upper and lower sides in the direction along the center axis J1 of an inner circumferential surface of the first bearing holding portion 2212. The ball bearings 2213 and 2214 rotatably support the first shaft 2223.

The first armature 2215 includes a stator core, a coil, and a plurality of insulators. The stator core is defined by laminating a plurality of thin silicon steel plates. The insulators are attached to the upper and lower sides of the stator core in the direction along the center axis J1. The insulators are made from an insulating material (a resin or plastic, for example). The coil is defined by winding one or more copper wires around a stator core over the insulators.

The first armature 2215 has a through hole extending through its center in the direction along the center axis J1. An inner circumferential surface of the through hole of the first armature 2215 is fixed and held by an outer circumferential surface of the first bearing holding portion 2212. The first armature 2215 is radially opposed to the first field magnet 2222.

The first circuit board 2216 has a substantially annular disc shape. The first circuit board 2216 is positioned on the lower side in the direction along the center axis J1 of the first armature 2215. One end of the copper wire of the coil is electrically connected to the first circuit board 2216. A plurality of lead wires (not shown) connect the first circuit board 2216 to an external power supply (not shown). The lead wires supply a current from the external power supply, and transmit a control signal for controlling the current to the first circuit board 2216.

When a current is supplied to the first armature 2215 from the external power supply via both the plurality of lead wires and the first circuit board 2216, a magnetic field is generated in the first armature 2215. Due to an interaction of the magnetic field generated in the first armature 2215 with the magnetic field generated by the first field magnet 2222, a torque with the center axis J1 as its center is generated between the first armature 2215 and the first field magnet 2222. As a result of this torque, the first rotor portion 222 and the first impeller 21 attached to the first yoke 2221 of the first rotor portion 222 are driven so as to rotate around the center axis J1. An airflow circulating from the upper side to the lower side in the direction along the center axis J1 is generated by the rotation of the first impeller 21. In other words, in response to the rotation of the first impeller 21, air is circulated in from the upper side in the direction along the center axis J1, and is discharged to the lower side in the direction along the center axis J1.

Next, the second axial fan 3 which defines the fan unit 101 will be described. The structure of the second axial fan 3 is substantially the same as that of the first axial fan 2.

As shown in FIG. 2, the second axial fan 3 preferably includes a second impeller 31, a second motor portion 32, a second housing 33, and a plurality of second supporting ribs 34.

The second housing 33 is a hollow member having a through hole extending in the direction along the center axis J1. Similarly to the first housing 23, an outer shape of the second housing 33 is substantially rectangular when viewed from the direction along the center axis J1. An outer shape of the through hole is substantially circular. When the fan unit 101 is installed on the inside of the casing 100, an outer side surface of the second housing 33 substantially abuts against the inner side surface of the casing 100 substantially without any gaps. As shown in FIG. 2, the second impeller 31, the second motor portion 32, and the second supporting ribs 34 are disposed on the inside of the second housing 33. An end portion of the second housing 33 on the upper side in the direction along the center axis J1 axially abuts against an end portion of the first housing 34 on the lower side in the direction along the center axis J1. The second housing 33 is fixed to the first housing 23 by an engaging device. The engaging device is not specifically limited, but may be a clip, a locking structure, an adhesive, or the like. The airflow generated by the rotation of the first impeller 21 is prevented from escaping outside of the fan unit through the abutting portion of the second housing 33 and the first housing 23 because the end portion of the second housing 33 on the upper side in the direction along the center axis J1 axially abuts against the end portion of the first housing 23 on the lower side in the direction along the center axis J1.

As shown in FIG. 2, the second impeller 31 includes a plurality of second vanes 311 and a second hub 312 having a cupped and substantially cylindrical shape. The plurality of second vanes 311 extend radially outwards from an outer circumferential surface of the second hub 312. On the outer circumferential surface of the second hub 312, the second vanes 311 are disposed at regular pitches in the circumferential direction with the center axis J1 as their center. The second hub 312 and the second vanes 311 are preferably integrally formed by injection molding with a resin or plastic. The second motor portion 32 drives the second impeller 31 so as to rotate it around the center axis J1.

The second motor portion 32 includes a second stator portion 321 and a second rotor portion 322. The second rotor portion 322 rotates around the center axis J1 in a relative manner to the second stator portion 321.

The second rotor portion 322 includes a second yoke 3221, a second field magnet 3222, and a second shaft 3223.

The second yoke 3221 has a cupped and substantially cylindrical shape, and is made from a magnetic metal. The second yoke 3221 is fixed to the inside of the second hub 312 of the second impeller 31 by an adhesive, press fitting, or the like. In a center portion of the cover portion of the second yoke 3221, a cylindrical portion is arranged to extend downwards in the direction along the center axis J1. In the cylindrical portion, a through hole extending in the direction along the center axis J1 is provided.

The second field magnet 3222 is substantially annular. An outer circumferential surface of the second field magnet 3222 is held by an inner circumferential surface of the second yoke 3221 by press fitting, an adhesive, or the like.

The second shaft 3223 is preferably made of a metal, and is defined by a substantially rod-like shape. An end portion of the second shaft 3223 on the upper side in the direction along the center axis J1 is fixed to the through hole in the cylindrical portion of the cover portion of the second yoke 3221 by press fitting, an adhesive, or the like.

As shown in FIG. 2, the second stator portion 321 includes a second base portion 3211, a second bearing holding portion 3212, ball bearings 3213 and 3214, a second armature 3215, a second circuit board 3216, and a second coil 3217.

The second base portion 3211 has a bottom portion and has a substantially cylindrical shape with the center axis J1 as the center. The bottom portion of the second base portion 3211 is axially opposed to the bottom portion of the first base portion 2211. It is desirable that the bottom portion of the second base portion 3211 be in contact with the bottom portion of the first base portion 2211. However, they may not be in contact with each other. In a center portion of the bottom portion of the second base portion 3211, an opening extending in the direction along the center axis J1 is provided. The second base portion 3211 holds respective portions of the second stator portion 321. The second supporting ribs 34 extend from an inner circumferential surface 331 of the second housing 33, and are connected to an outer circumferential surface of the second base portion 3211. The second supporting ribs 34 are disposed at regular pitches in the circumferential direction with the center axis J1 as the center in a radial space between the second base portion 3211 and the inner circumferential surface 331 of the second housing 33. The second housing 33, the second base portion 3211, and the second supporting ribs 34 are preferably integrally formed by injection molding with a resin or a plastic. Alternatively, the second housing 33, the second base portion 3211, and the second supporting ribs 34 may be integrally formed by aluminum die-casting.

Although not shown in the figures, in the present preferred embodiment, the number of the second supporting ribs 34 is the same as that of the first supporting ribs 24. The second supporting ribs 34 are opposed to the first supporting ribs 24 in the direction along the center axis J1. When viewed from the direction along the center axis J1, the first supporting ribs 24 overlap with the second supporting ribs 34. That is, one of the first supporting ribs 24 and a corresponding one of the second supporting ribs 34 virtually define one supporting rib. Accordingly, noise caused by a force of the airflow generated by the rotation of the first impeller 21 contacting the first supporting ribs 24 and the second supporting ribs 34 can be reduced. The first supporting ribs 24 may axially abut against the second supporting ribs 34, or they may be opposed to the second supporting ribs 34 with a gap disposed in between.

As shown in FIG. 2, the second bearing holding portion 3212 is positioned in the center portion of the bottom portion of the second base portion 3211. An end of the second bearing holding portion 3212 in the direction along the center axis J1 is held in place by the opening of the center portion of the bottom portion of the second base portion 3211.

The ball bearings 3213 and 3214 are attached to an inner circumferential surface of the second bearing holding portion 3212 on the upper side and the lower side in the direction along the center axis J1. The ball bearings 3213 and 3214 rotatably support the second shaft 3223.

The second armature 3215 includes a stator core, a second coil 3217, and insulators. The stator core is formed by laminating a plurality of thin silicon steel plates. The insulators are attached on the axially upper and lower sides of the stator core. The insulators are made of an insulating material (a resin or plastic, for example). The coil is formed by winding one or a plurality of copper wires around the insulators on the stator core. The second armature 3215 has a through hole extending in the direction along the center axis J1 in the center thereof. An inner circumferential surface of the through hole of the second armature 3215 is held by an outer circumferential surface of the second bearing holding portion 3212. The second armature 3215 is radially opposed to the second field magnet 3222.

The second circuit board 3216 has a substantial annular disc shape. The second circuit board 3216 is positioned on the lower side of the second armature 3215 in the direction along the center axis J1. One end of the copper wire of the coil is electrically connected to the second circuit board 3216. A plurality of lead wires (not shown) connect the second circuit board 3216 to an external power supply (not shown). The lead wires not only supply a current from the external power supply, but they also transmit a control signal for controlling the current to the second circuit board 3216.

A magnetic field is generated in the second armature 3215 when a current is supplied from the external power supply to the second armature 3215 via the plurality of lead wires and the second circuit board 3216. Due to the interaction of the magnetic field generated in the second armature 3215 with the magnetic field of the second field magnet 3222, a torque with the center axis J1 as the center is generated between the second armature 3215 and the second field magnet 3222. As a result of this torque, the second rotor portion 322 and the second impeller 31 attached to the second yoke 3221 of the second rotor portion 322 are driven so as to rotate around the center axis J1.

When the fan unit 101 is viewed from the direction along the center axis J1, the direction of rotation of the second impeller 31 around the center axis J1 is preferably opposite to the direction of rotation of the first impeller 21 around the center axis J1. The airflow generated by the rotation of the first impeller 21 includes an axial component in the direction along the center axis J1, a rotating component rotating around the center axis, and a centrifugal component directed radially outwards from the center axis J1. The rotating component of the airflow generated by the rotation of the first impeller 21 is converted into an axial component by the second impeller 31 because of the opposite directions of rotation of the first impeller 21 and the second impeller 31. Accordingly, both the amount and the static pressure of the air discharged from the fan unit 101 can be increased.

Next, the duct 102 will be described. As shown in FIGS. 1 and 4, the duct 102 is attached to the outlet side of an end portion 301 of the second housing 33 of the fan unit 101.

As shown in FIGS. 1, 3, and 4, the duct 102, which is preferably made from a resin or plastic, is a hollow member having a through hole extending in the direction along the center axis J1. Openings 1021 and 1022 are provided on an inlet side (on the side of the second housing 33 in the direction along the center axis J1) and on an outlet side (on the side opposite to the side of the second housing 33 in the direction along the center axis J1) of the duct 102 in the direction along the center axis J1. When viewed from the direction along the center axis J1, the openings 1021 and 1022 preferably are substantially circular. When viewed from the direction along the center axis J1, the shape of an inner circumferential surface of the duct 102 preferably is also substantially circular.

As shown in FIG. 3, when viewed from the direction along the center axis J1, the shape of the opening 1021 of the duct 102 is substantially the same as that of an outlet 3011 of the second housing 33 of the second axial fan 3. When the duct 102 is coupled to the fan unit 101, and are viewed from the direction along the center axis J1, the opening 1021 of the duct 102 substantially overlaps with the outlet 3011 of the second housing 33. Accordingly, when the duct 102 is coupled to the fan unit 101, the air discharged from the fan unit 101 is preferably prevented from contacting the end portion of the duct 102 on the upper side in the direction along the center axis J1 (on the inlet side in the direction along the center axis J1). Alternatively, when viewed from the direction along the center axis J1, the opening 1021 of the duct 102 may at least partially overlap with the outlet 3011 of the second housing 33.

Because the shape of the outlet 3011 of the second housing 33 is substantially the same as that of the opening 1021 of the duct 102, when the fan unit 101 and the duct 102 are coupled, irregularities are not formed in a joining portion between the inner circumferential surface 331 of the second housing 33 and the hollow portion of the duct 102. Accordingly, when air discharged from the fan unit 101 passes through the joining portion between the inner circumferential surface 331 of the second housing 33 and the hollow portion of the duct 102 in the direction along the center axis J1, the air can flow smoothly. For this reason, when the air discharged from the second axial fan 3 flows through the joining portion between the inner circumferential surface 331 of the second housing 33 and the hollow portion of the duct 102, a reduction in a flow rate of the airflow can be minimized. In addition, the noise caused by the air coming into contact with the joining portion can be minimized.

When the fan unit 101 and the duct 102 are coupled, an end portion 301 of the second housing 33 on the outlet side in the direction along the center axis J1 abuts against an end portion of the duct 102 on the inlet side in the direction along the center axis J1. Accordingly, it is preferable to insure that no gaps are formed in a portion of the duct 102 that abuts against the second housing 33. That is, air discharged from the second axial fan 3 is prevented from escaping from the abutting portion to an outside of the duct 102 and the fan unit 101.

As shown in FIG. 4, when viewed from the direction along the center axis J1, the shape of an opening 1022 of the duct 102 is substantially the same as that of an outlet-side opening 1001 of the casing 100. Accordingly, when the duct 102 is attached to the inside of the casing 100, and is viewed from the direction along the center axis J1, the outlet-side opening 1001 of the casing 100 substantially overlaps the opening 1022 of the duct 102. The opening 1022 of the duct 102 and the opening 1001 of the casing 100 on the outlet side are axially coupled substantially without any gaps. As a result, air discharged from the opening 1022 of the duct 102 does not escape from between the duct 102 and the casing 100. Since the shape of the opening 1022 of the duct 102 is substantially the same as that of the outlet-side opening 1001 of the casing 100, no irregularities are formed in a joining portion between the outlet-side opening 1001 of the casing 100 and the opening 1022 of the duct. Thus, the air discharged from the duct 102 can flow smoothly through the joining portion between the opening 1022 of the duct 102 and the outlet-side opening 1001 of the casing 100. Therefore, it is possible to minimize a reduction in the flow rate of the air discharged from the duct 102 due to the air discharged from the duct 102 contacting the joining portion between the opening 1022 of the duct 102 and the outlet-side opening 1001 of the casing 100. It is also possible to reduce the noise caused by the air discharged from the duct 102 contacting with the joining portion between the opening 1022 of the duct 102 and the outlet-side opening 1001 of the casing 100.

As shown in FIGS. 1, 3, and 4, an inner circumferential surface of the duct 102 has a smooth surface with minimal irregularities, and extends substantially in parallel with the center axis J1 in the direction along the center axis J1. Because of this, it is possible to prevent the flow rate from being reduced when air discharged from the fan unit 101 flows across the inner circumferential surface of the duct 102.

The air discharged from the fan unit 101 includes an axial component (flowing in the direction along the center axis J1), a rotating component (flowing in the circumferential direction with the center axis J1 as the center), and a centrifugal component (flowing radially outward from the center axis J1). When the duct 102 is provided on the outlet side of the fan unit 101, air discharged from the fan unit 101 flows into the inside of the duct 102, and contacts the inner circumferential surface of the duct 102. As described above, the inner circumferential surface of the duct 102 is smooth such that the loss of air flow due to the contact of the air with the inner circumferential surface of the duct 102 can be kept to a minimum, and the centrifugal component of the airflow is converted into the axial component. In other words, the airflow is channeled into a direction along the center axis J1 by the duct 102.

As shown in FIG. 1, in the present preferred embodiment, the length obtained by adding the length of the fan unit 101 in the direction along the center axis J1 to the length of the duct 102 in the direction along the center axis J1 is substantially the same as that of the casing 100 in the direction along the center axis J1. However, the length of the duct 102 in the direction along the center axis J1 is not specifically limited. For example, the duct 102 may protrude from the outlet of the casing 100 in the direction along the center axis J1. Alternatively, the opening 1022 of the duct 102 on the outlet side may be arranged in a position closer to the inlet side of the casing 100 than the outlet side thereof in the direction along the center axis J1.

Now the arrangement of the fan unit 101 on the inside of the casing 100 will be described. In the present preferred embodiment, the fan unit 101 is arranged on the side of an inlet-side opening 1000 of the casing 100 in the axial direction.

FIGS. 5A, 5B, 5C, and 5D are sectional views of a casing and a fan unit disposed in the casing. FIGS. 5A, 5B, 5C, and 5D show the conditions in which the axial position of the fan unit 101 in the casing 100 is varied.

Figure 5A:
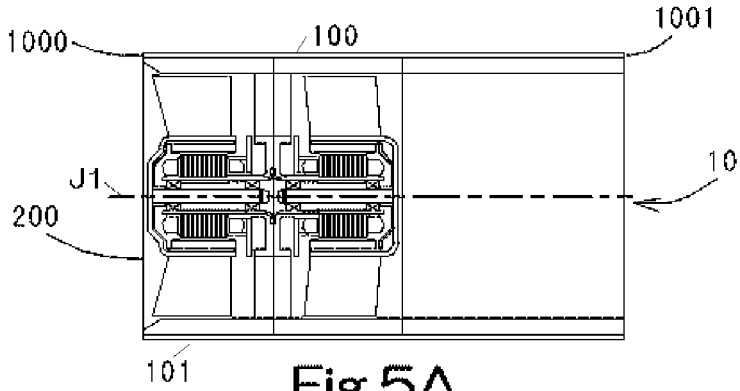
FIG. 5A is a sectional view of a casing and a fan unit disposed in the casing.
Figure 5B:
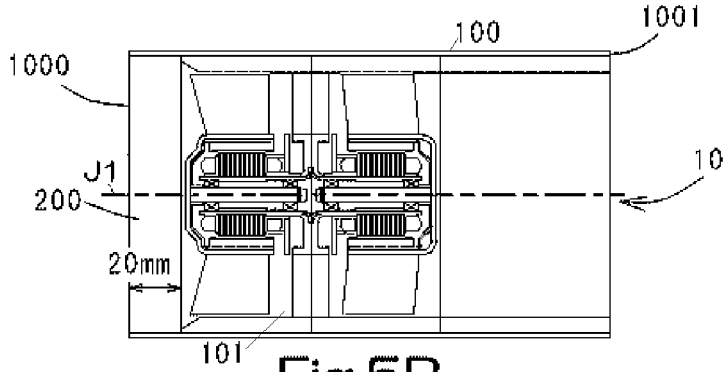
FIG. 5B is a sectional view of a casing and a fan unit disposed in the casing.
Figure 5C:
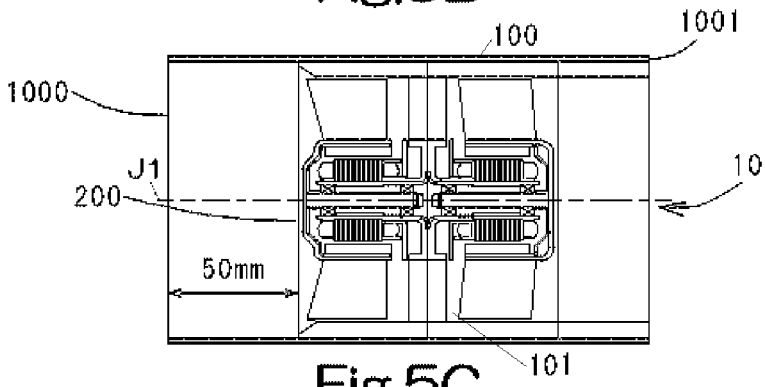
FIG. 5C is a sectional view of a casing and a fan unit disposed in the casing.
Figure 5D:
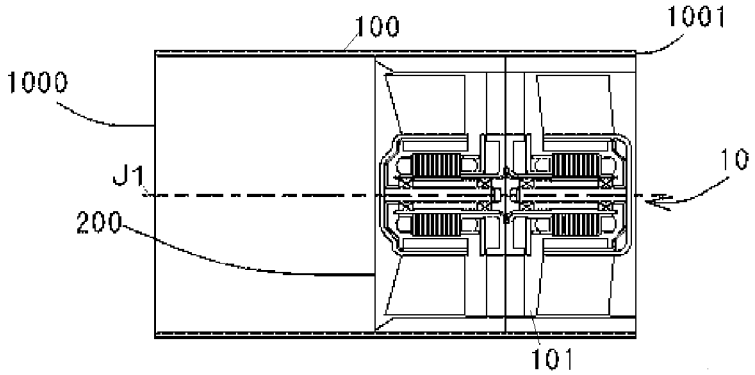
FIG. 5D is a sectional view of a casing and a fan unit disposed in the casing.

FIG. 5A shows a condition in which the position of the fan unit 101 on an inlet-side end surface 200 of the first housing 22 is matched with the position of the inlet-side opening 1000 of the casing 100 in the direction along the center axis J1. The position of the fan unit 101 in the present preferred embodiment is similar to that in the condition shown in FIG. 5A. In FIG. 5B, the position of the inlet-side end surface 200 of the first housing 22 of the fan unit 101 is axially shifted by about 20 mm, for example, from a position matched with the position of the inlet-side opening 1000 of the casing 100 (i.e., the position shown in FIG. 5A) to the outlet side (to the side of the opening 1001 of the casing 100) in the direction along the center axis J1. FIG. 5C shows a condition where the position of the inlet-side end surface 200 of the first housing 22 of the fan unit 101 is axially shifted by about 50 mm, for example, from a position matched with the position of the inlet-side opening 1000 of the casing 100 (i.e., the position shown in FIG. 5A) to the outlet side (to the side of the opening 1001 of the casing 100) in the direction along the center axis J1. FIG. 5D shows a condition where the position of the inlet-side end surface 200 of the first housing 22 of the fan unit 101 is matched with a position of the opening 1001 of the casing 100 in the direction along the center axis J1.

Figure 6:
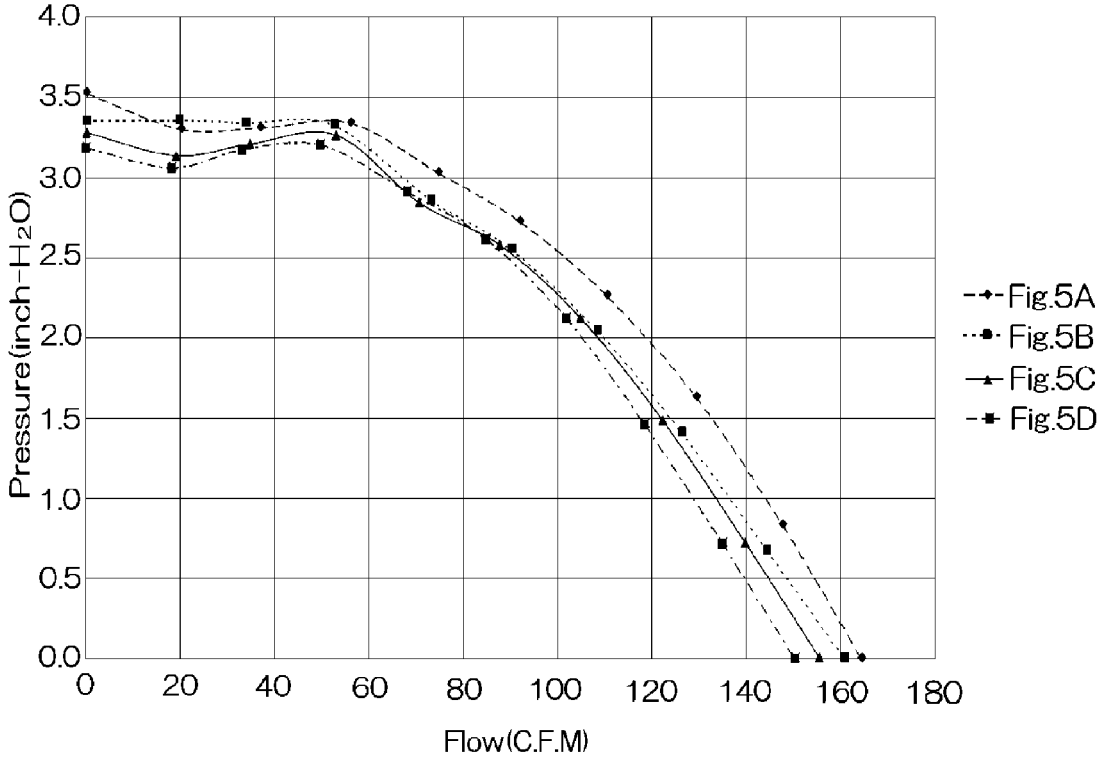
FIG. 6 is a graph showing a relationship between static pressure and air flow of the fan units shown in FIGS. 5A to 5D.

FIG. 6 is a graph showing the relationship between the static pressure and the air flow of the fan units shown in FIGS. 5A to 5D. In FIG. 6, the x-axis indicates the air flow (C.F.M), and the y-axis indicates the static pressure (inch-$H_2O$). In FIG. 6, as the value of the x-axis increases (i.e., to the right side in FIG. 6), the air flow of the fan unit becomes larger. Also, as the value of the y-axis increases (i.e., to the upper side in FIG. 6), the static pressure of the fan unit becomes higher. In other words, as the value of the x-axis and the value of the y-axis become larger (i.e., to the upper right side in FIG. 6), both the air flow and the static pressure of the fan unit are increased.

As shown in FIG. 6, when the fan units shown in FIGS. 5A to 5D are compared, when the air flow is in the range of about 20 C.F.M to about 60 C.F.M and the static pressure is in the range of about 3.0 inch-$H_2O$ to 3.5 inch-$H_2O$, the line of FIG. 5B is higher than the line of FIG. 5A. That is, when the static pressure in the fan unit is high, the fan unit disposed in the position shown in FIG. 5B exhibits superior properties than that of the fan unit disposed in the position shown in FIG. 5A. However, in FIG. 6, when the air flow is in the range of about 60 C.F.M to about 160 C.F.M, the line of FIG. 5A is higher than the line of FIG. 5B. That is, in substantially all conditions, except for when there is a high static pressure, the fan unit disposed in the position shown in FIG. 5A exhibits superior properties to that of the fan unit disposed in the position shown in FIG. 5B. As a result, it is understood that except for instances of high static pressure, when the air flow and the static pressure of a fan apparatus is to be increased, it is preferable to dispose the inlet of the fan unit closer to the inlet side of the casing.

As shown in FIG. 1, in the first preferred embodiment of the present invention, the fan unit is disposed in the position shown in FIG. 5A. Specifically, the inlet-side end surface 200 of the first housing 22 of the fan unit 101 is arranged to be even with the inlet-side opening 1000 of the casing 100. Accordingly, in the fan apparatus the first preferred embodiment of the present invention, air can be discharged with both a large air flow and a high static pressure.

Various preferred embodiments of the present invention are described above, but the configurations can be varied. Hereinafter, modifications of the duct and the fan unit will be described.

Figure 7:
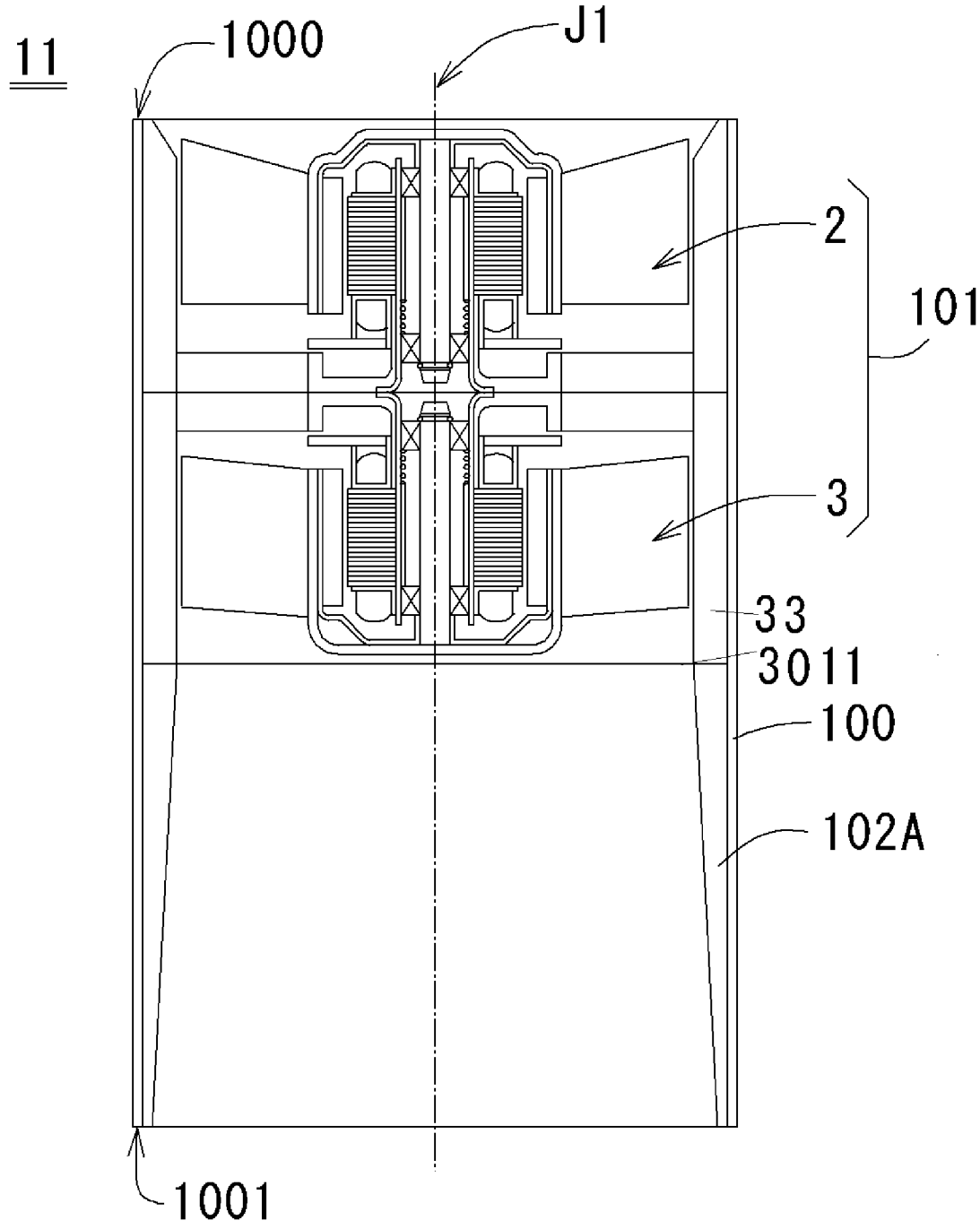
FIG. 7 is a sectional view showing a modification of the fan apparatus of the first preferred embodiment of the present invention.

FIG. 7 is a sectional view showing a modification of the fan apparatus of the first preferred embodiment of the present invention. The shape of the duct of the fan apparatus 11 shown in FIG. 7 is different from that of the fan apparatus 10 shown in FIG. 1. In the following description, components of the fan apparatus 11 that are the same as those of the fan apparatus 10 are designated by the identical reference numerals.

As shown in FIG. 7, the fan apparatus 11 includes a casing 100, a fan unit 101, and a duct 102A. The duct 102A is a hollow member having a through hole extending in a direction along the center axis J1. In a similar arrangement as that of the duct 102 shown in FIG. 1, an opening of the duct 102A on the inlet side in the direction along the center axis J1 axially abuts against an end portion of the fan unit 101 on the outlet side in the direction along the center axis J1. When viewed from the direction along the center axis J1, the shape of the opening of the duct 102A on the inlet side in the direction along the center axis J1 is substantially the same as that of an outlet 3011 of a second housing 33 of a second axial fan 3.

As shown in FIG. 7, the thickness of the duct 102A in the radial direction is gradually reduced from the inlet side to the outlet side in the direction along the center axis J1. In other words, the inner diameter of the through hole of the duct 102A in the radial direction gradually increases from the inlet side to the outlet side in the direction along the center axis J1. When viewed from the direction along the center axis J1, the opening area of the through hole (the hollow portion) of the duct 102A on the outlet side is larger than the opening area of the through hole (the hollow portion) of the duct 102A on the inlet side. Using such a configuration, the reduction of the flow rate due to air discharged from the fan unit 101 contacting the inner circumferential surface of the through hole of the duct 102A can be minimized, and the rotating component of the airflow can be converted into the axial component. That is, in the inside of the duct 102A, the air flows smoothly while it is channeled into a direction along the center axis J1.

Figure 8:
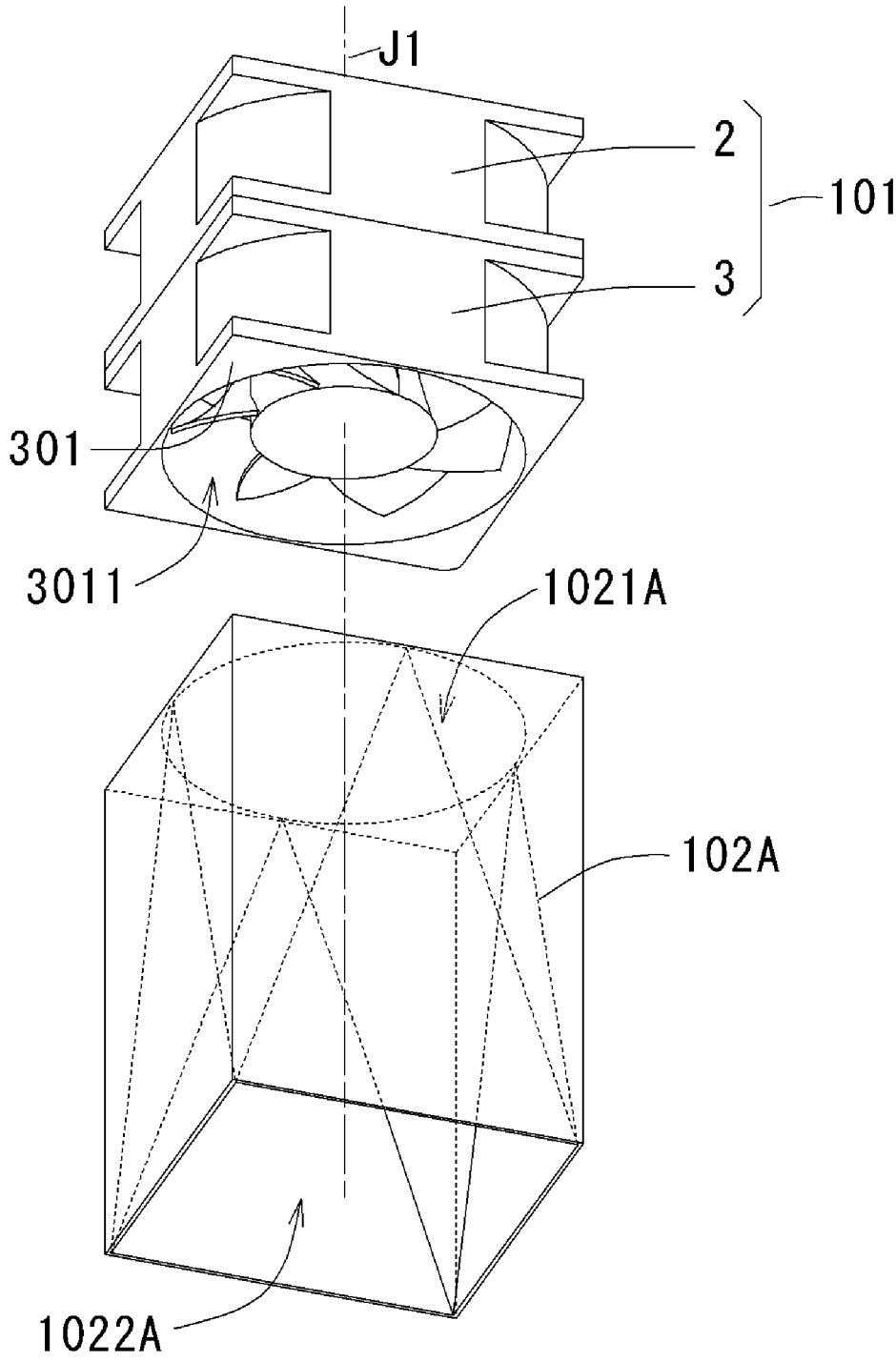
FIG. 8 is a perspective view showing a modification of the fan unit and the duct in the first preferred embodiment of the present invention.

FIG. 8 is a perspective view showing a modification of the fan unit and the duct in the first preferred embodiment of the present invention. In the following description, components of the fan unit 101 and the duct 102A shown in FIG. 8 that are the same as those in fan apparatuses 10 and 11 are designated by identical reference numerals.

As shown in FIG. 8, a duct 102A is a hollow member that has openings 1021A and 1022A. An opening 1021A is provided on an inlet side (on the upper side in FIG. 8). As shown in FIG. 8, the shape of the opening 1021A is substantially the same as that of an outlet 3011 of a second axial fan 3. An opening 1022A is also provided on the outlet side (on the lower side in FIG. 8). The shape of the opening 1022A is substantially rectangular. When viewed from the inlet side, the shape of the duct 102A is substantially rectangular. The hollow portion of the duct 102A functions as a path through which air discharged from the fan unit 101 passes. That is, the hollow portion of the duct 102A is a path having the opening 1021A as the inlet and the opening 1022A as the outlet. When viewed from the inlet side, the sectional area of the flow path of the duct 102A (i.e., the opening area) gradually increases from the inlet side to the outlet side (i.e., from the opening 1021A to the opening 1022A). In other words, when viewed from the inlet side, the opening area of the flow path of the duct 102A on the outlet side in the axial direction is larger than that of the inlet side in the axial direction. In addition, in the flow path of the duct 102A, there is no portion in which the sectional area changes greatly. The flow path of the duct 102A extends in the direction along the center axis J1, and is defined by a plurality of planes that are inclined with respect to the center axis J1. Accordingly, the air discharged from the fan unit 101 can flow smoothly through the flow path. As a result, noise caused by the contacting of air with the flow path can be reduced.

The shapes of the openings of the duct on the inlet side and on the outlet side are not specifically limited. In addition to the above-described shapes, the shape may be polygonal or elliptic, when viewed from either the inlet side or the outlet side.

The shape of the hollow portion of the duct (i.e., the flow path through which the air discharged from the fan unit circulates) is not specifically limited. The sectional area of the flow path may be gradually increased, gradually decreased, or may be constant from the inlet side to the outlet side, when viewed from either the inlet side or the outlet side. Alternatively, there may be an irregularity provided in the flow path.

Figure 9:
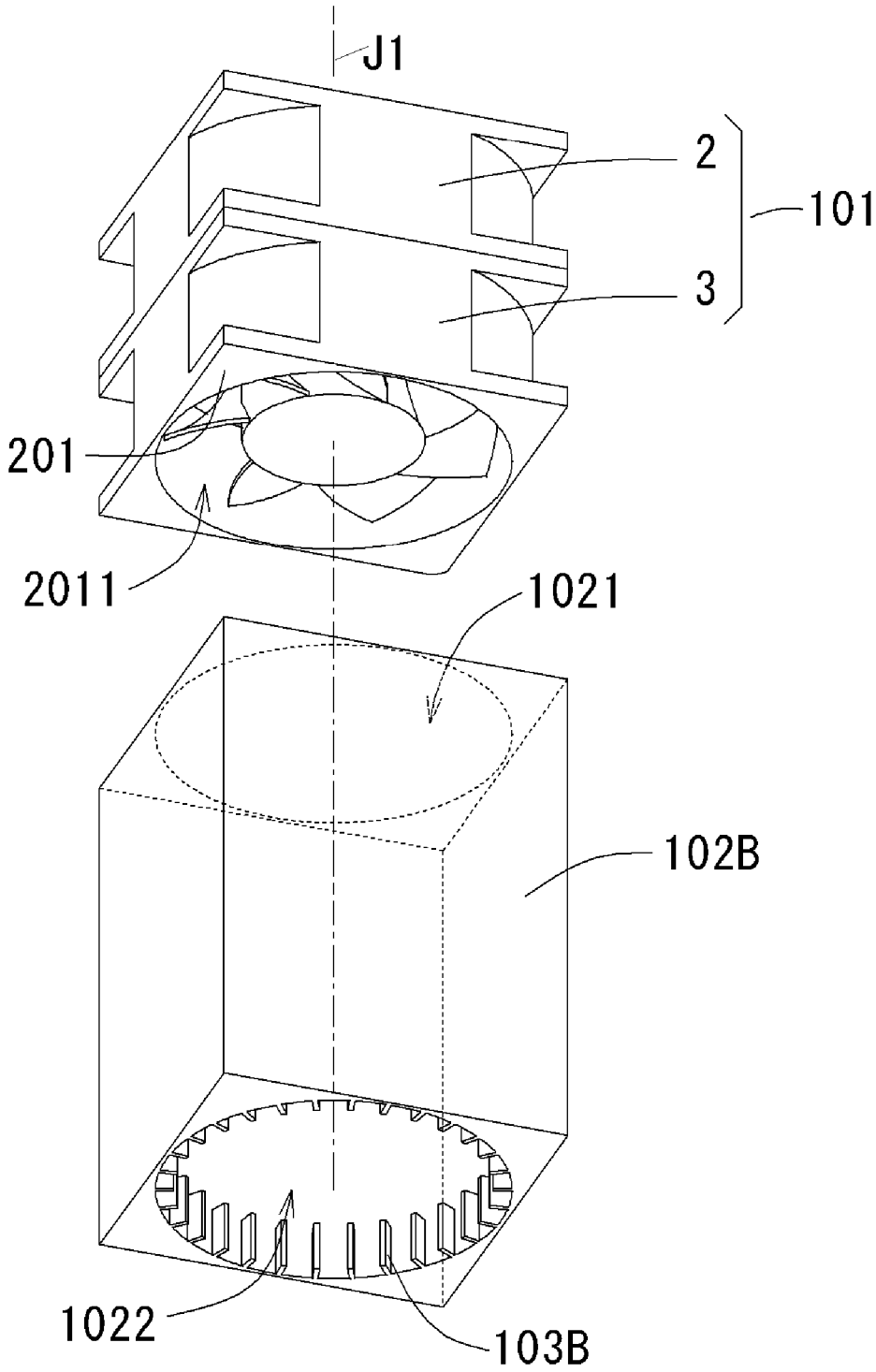
FIG. 9 is a perspective view showing a modification of the fan unit and the duct in the first preferred embodiment of the present invention.

In addition, convex or concave portions may be provided in the opening or on the circumferential surface of the duct. FIG. 9 is a perspective view showing a modification of the fan unit and the duct of the first preferred embodiment of the present invention. On the inner circumferential surface of a duct 102B, a plurality of air-straightening plates 103B are arranged at regular pitches in the circumferential direction with the center axis J1 as the center. Each of the air straightening plates 103B extends from the inner circumferential surface of the duct 102B in the direction along the center axis J1. Using this configuration, air flowing from the inlet side to the outlet side in the direction along the center axis J1 can be straightened and discharged from an outlet 1022 of the duct 102B. As a result of this, noise caused by the turbulent flow of the discharged air can be reduced. In addition, it is also possible to increase the air flow and the static pressure of the discharged air. The shape of the air-straightening plates 103B and the positions where the air-straightening plates 103B are disposed on the inner circumferential surface of the duct 102B are not specifically limited.

Figure 10:
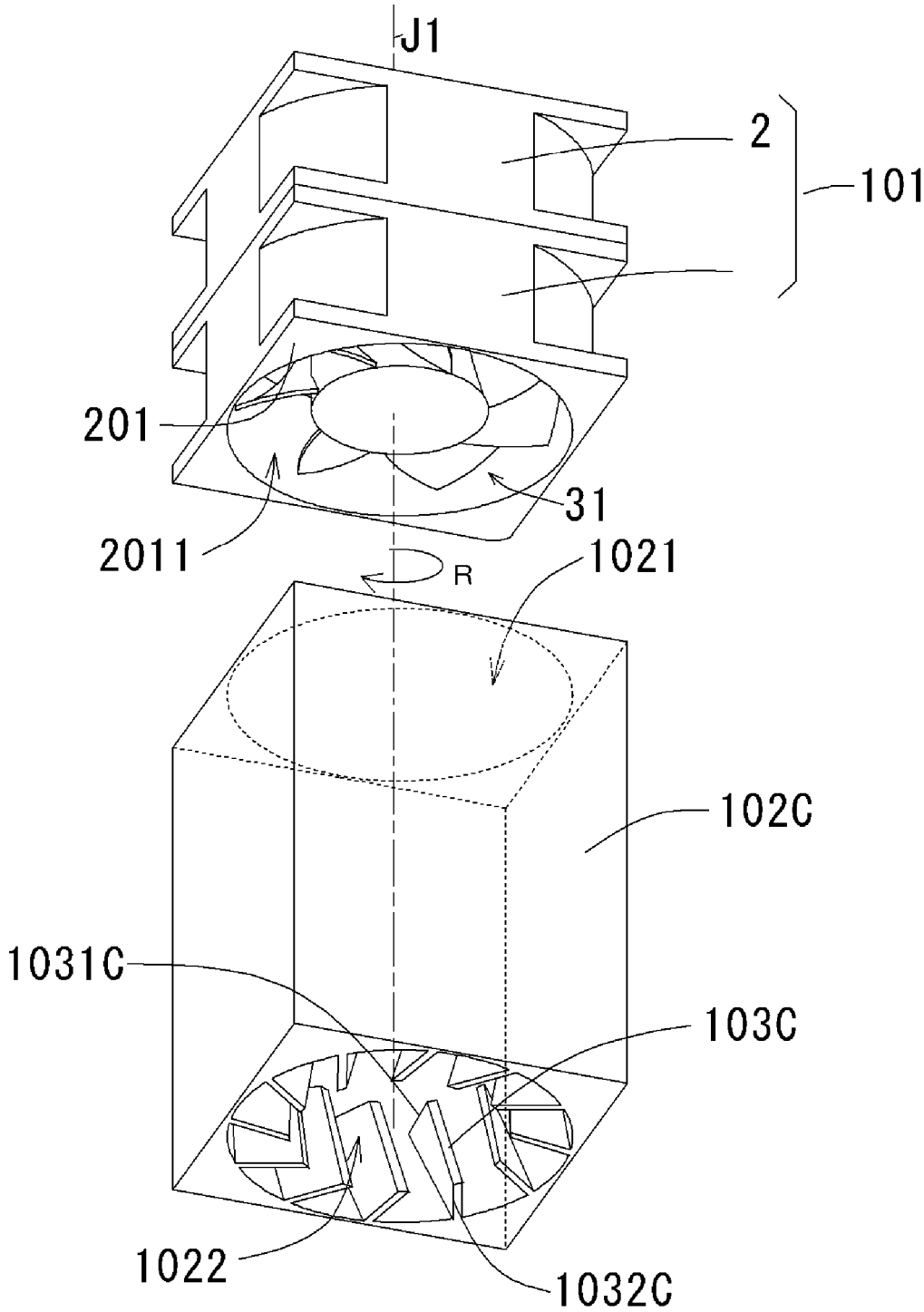
FIG. 10 is a perspective view showing a modification of the fan unit and the duct in the first preferred embodiment of the present invention.

FIG. 10 is a perspective view showing a modification of the fan unit and the duct of the first preferred embodiment of the present invention. On an inner circumferential surface of a duct 102C, a plurality of stationary blades 103C are arranged at regular pitches in the circumferential direction with the center axis J1 as the center. The stationary blades 103C in FIG. 10 are plate-like blade members tilted with respect to the center axis J1. Using this configuration, the air discharged from an outlet 1022 of the duct 102C contacts the stationary blades 103C, so that a rotating component of the airflow is converted into an axial component. In other words, due to the contact of the air with the stationary blades 103C, static pressure and air flow of the air can be increased.

The positions where the stationary blades 103C are arranged on the inside of the duct 102C are not specifically limited. An inlet-side end portion 1031C of the stationary blade 103C is positioned in a direction opposite to a direction of rotation R of the second impeller 31 as compared with an outlet-side end portion 1032C in the circumferential direction with the center axis J1 as the center.

The stationary blade 103C is preferably thin. However, the shape of the stationary blade 103C is not specifically limited. The shape of the stationary blade 103C may be an airfoil shape, a plate-like shape, or any other suitable shape.

Next, a modification of the fan unit of the first preferred embodiment of the present invention will be described. In the following description, the same components as those of the above-described fan apparatus are designated by the identical reference numerals.

Figure 11:
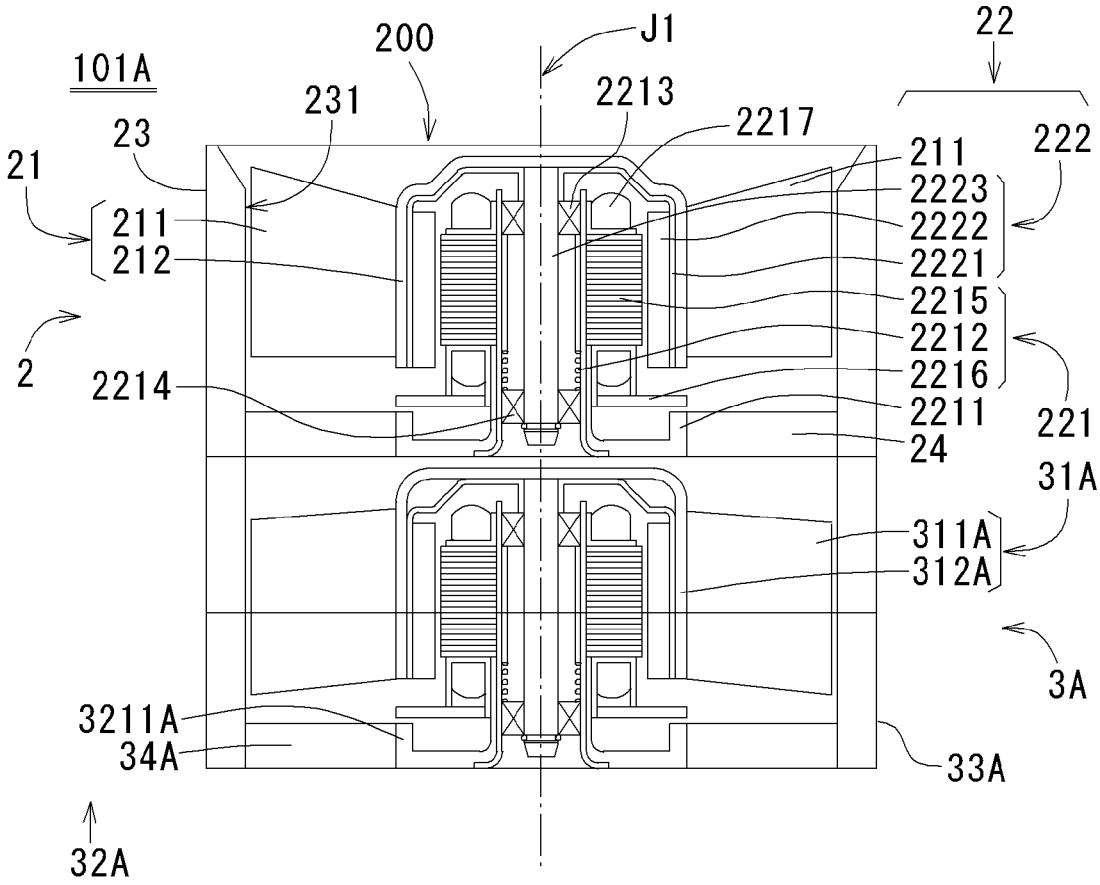
FIG. 11 is a sectional view showing a modification of the fan unit in the first preferred embodiment of the present invention.

FIG. 11 is a sectional view showing a modification of the fan unit of the first preferred embodiment of the present invention. The difference between the configuration of the fan unit 101A shown in FIG. 11 and that of the fan unit 101 shown in FIGS. 1 and 2 is in the arrangement of a second axial fan.

As shown in FIG. 11, the fan unit 101A has a first axial fan 2 and a second axial fan 3A. The second axial fan 3A has substantially the same configuration as that of the second axial fan 3 shown in FIGS. 1 and 2.

As shown in FIG. 11, the second axial fan 3A includes a second impeller 31A, a second motor portion 32A, a second housing 33A, and second supporting ribs 34A. The structures of the second motor portion 32A and the second housing 33A shown in FIG. 11 are substantially the same as those of the second motor portion 32 and the second housing 33 shown in FIGS. 1 and 2.

The second housing 33A is a hollow member having a thorough hole extending in a direction along the center axis J1. When viewed from the direction along the center axis J1, the outer shape of the second housing 33A is substantially rectangular. An outer periphery of the through hole of the second housing 33A is substantially circular. The second impeller 31A, the second motor portion 32A, and the second supporting ribs 34A are arranged on the inside of the second housing 33A (i.e., in the thorough hole).

The second impeller 31A includes a second hub 312A and a plurality of second vanes 311A. The second hub 312A has a cupped and substantially cylindrical shape. The second vanes 311A extend radially outwards from an outer circumferential surface of the second hub 312A. The second vanes 311A are disposed at regular pitches on the outer circumferential surface of the second hub 312A in the circumferential direction with the center axis J1 as the center.

The second impeller 31A is driven by the second motor portion 32A so as to rotate around the center axis J1. When the second impeller 31A rotates, an airflow flowing from an inlet side to an outlet side in the direction along the center axis J1 (from the upper side to the lower side in FIG. 11) is generated. Herein, the direction of rotation of the second impeller 31A with the center axis J1 as the center is preferably opposite to the direction of rotation of the first impeller 21 of the first axial fan 2 with the center axis J1 as the center. For this reason, when the air discharged from the first axial fan 2 enters into the second axial fan 3A, a rotating component of the airflow is converted into an axial component by the rotation of the second impeller 31A. As a result, the static pressure of the air discharged from the second axial fan is increased.

The second motor portion 32A is disposed on the lower side of the second impeller 31A in the direction along the center axis J1. The second motor portion 32A has the same structure as that of the second motor portion 32 shown in FIGS. 1 and 2.

A second base portion 3211A of the second housing 33 is a member having a cupped and substantially cylindrical shape. The structure of the second base portion 3211A is the same as that of the second base portion 3211 shown in FIGS. 1 and 2. The second base portion 3211A supports the second motor portion 33A.

The second supporting ribs 34A extend radially outward from the inner circumferential surface 331A of the second housing 33A, and are connected to an outer circumferential surface of the second base portion 3211A. The second supporting ribs 34A are arranged at regular pitches in the circumferential direction with the center axis J1 as the center. The number of the second supporting ribs 34A is preferably the same as that of the first supporting ribs 24. If the number of the second supporting ribs 34A and the number of the first supporting ribs 24 are different from the number of the second vanes 311A, respectively, the number of the second supporting ribs 34A may be different from that of the first supporting ribs 24.

The sectional shape of the second supporting rib 34A in the direction along the center axis J1 is not specifically limited. The sectional shape of the second supporting rib 34A in the direction along the center axis J1 may be substantially polygonal, elliptic, or an airfoil, for example.

In the fan unit 101A shown in FIG. 11, the second axial fan 3A which is the same as the first axial fan 2 can be used. In the case where the second axial fan 3A is the same as the first axial fan 2, it is unnecessary to design and produce different types of fans. Accordingly, it is possible to reduce the cost and time required for the design and the production of different types of fans. Even in the case where the second axial fan 3A which is the same as the first axial fan 2 is used, the rotating direction of the second impeller 31A is preferably opposite to that of the first impeller 21.

Figure 12:
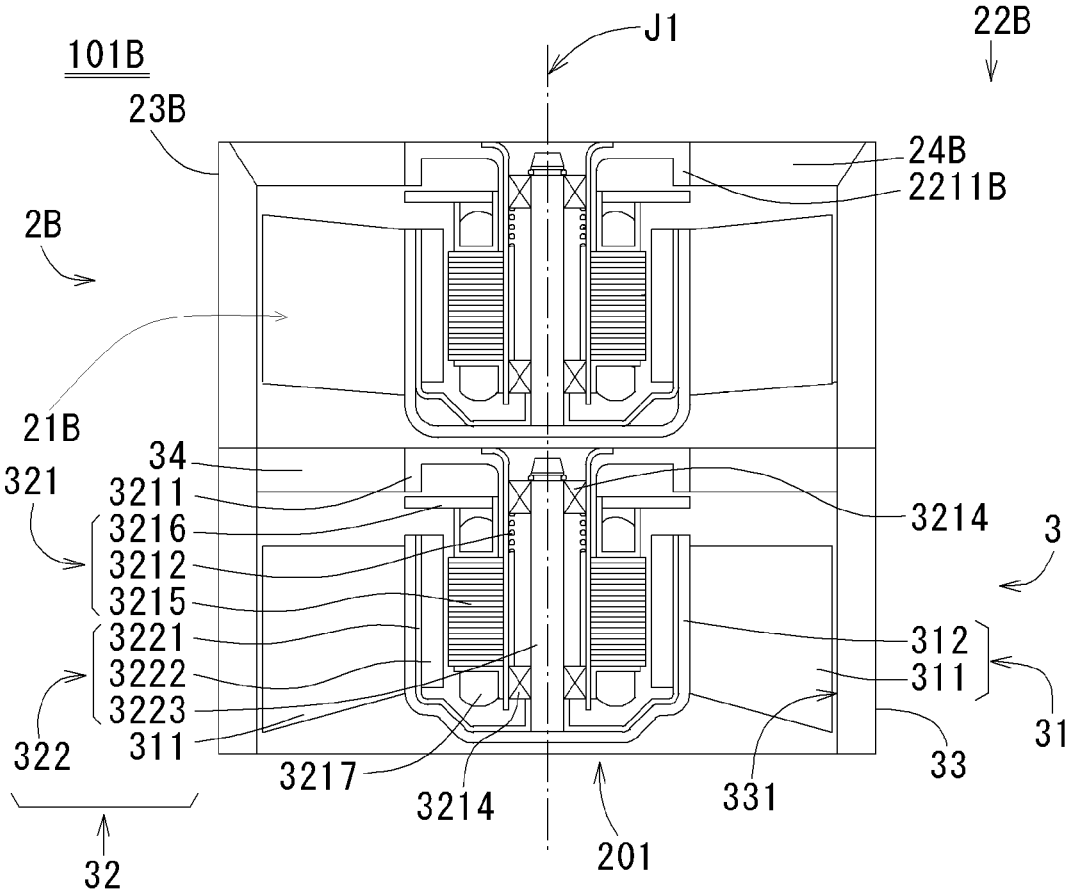
FIG. 12 is a sectional view showing a modification of the fan unit in the first preferred embodiment of the present invention.

FIG. 12 is a sectional view showing a modification of the fan unit of the first preferred embodiment of the present invention. As shown in FIG. 12, a fan unit 101B is defined by a first axial fan 2B and a second axial fan 3. The first axial fan 2B includes a first impeller 21B, a first motor portion 22B, a first housing 23B, and a plurality of first supporting ribs 24B. The structures of the first impeller 21B, the first motor portion 22B, the first housing 23B, and the plurality of first supporting ribs 24B are preferably the same as those of the first impeller 21, the first motor portion 22, the first housing 23, and the first supporting ribs 24 in the first axial fan shown in FIGS. 1 and 2. Similar to the structure of the first axial fan 2 shown in FIGS. 1 and 2, the first housing 23B, the first supporting ribs 24B, and the first base portion 2211B are preferably integrally formed by injection molding with a resin or a plastic.

As shown in FIG. 12, the first base portion 2211B and the first supporting ribs 24B are disposed on the inside of the first housing 23B of the first axial fan 2B on the inlet side in the direction along the center axis J1, and the first impeller 21B and the first motor portion 22B are disposed on the outlet side in the direction along the center axis J1. With this configuration, when the first impeller 21B is rotated, the air is channeled by the first supporting ribs 24B into the first housing 23B. As a result, the air channeled into the first housing 23B can flow smoothly through the first housing 23B. Thus, the noise caused by the contacting of air with the first impeller 21B and the inner circumferential surface of the first housing 23B can be minimized.

The number of the first supporting ribs 24B is preferably the same as the number of the second supporting ribs 34. In addition, if the number of second vanes 311 is the same as the number of the first supporting ribs 24B and the second supporting ribs 34, the noise caused by the contact of the air with the first supporting ribs 24B, the second vanes 311, and the second supporting ribs 34 is undesirably increased. For this reason, when the number of the second vanes 311 is different from that of the first supporting ribs 24B, and the number of the second vanes 311 is different from that of the second supporting ribs 34, the number of the first supporting ribs 24B should be the same as that of the second supporting ribs 34.

The direction of rotation of the first impeller 21B around the center axis J1 is preferably opposite to the direction of rotation of the second impeller 31 around the center axis J1. Accordingly, the air flow and the static pressure of the air discharged from the fan unit 101B can be increased.

In the above-described preferred embodiments and modifications, the first housing, the first base portion, the first supporting ribs, the second housing, the second base portion, and the second supporting ribs may be integrally formed by injection molding with a resin or a plastic, or they could be formed by aluminum die-casting.

Alternatively, in the above-described preferred embodiments and modifications, any one of the fan units 101, 101A, and 101B may be arbitrarily combined with any one of the ducts 102, 102A, and 102B.

In the above-described preferred embodiments and modifications, the duct and the casing may be integrally formed. Alternatively, the casing and the second housing may be integrally formed. In other words, the casing, the fan unit, and the duct may be respectively separate members, or may be integrally formed as one unitary member.

The fan unit may include three or more axial fans. The shape of the inlet of the first axial fan may be different from the shape of the inlet of the casing. For example, when viewed from the direction along the center axis, the inlet of the first axial fan may overlap with at least a portion of the inlet of the casing. The shape of the outlet of the second axial fan may be different from the shape of the inlet of the duct. For example, when viewed from the direction along the center axis, the outlet of the second axial fan may overlap with at least a portion of the inlet of the duct. In addition, the shape of the outlet of the duct may be different from the shape of the outlet of the casing. For example, when viewed from the axial direction, the outlet of the duct may overlap with at least a portion of the outlet of the casing.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A fan apparatus comprising:

a casing defined by a hollow member and including an inlet and an outlet a fan unit defined by a plurality of axial fans, the fan unit including an inlet and an outlet; and a duct defined by a hollow member including an inlet and an outlet on an inside of the casing, and the duct is arranged to couple the outlet of the fan unit to the outlet of the casing; wherein the fan unit is arranged on the inside of the casing, the inlet of the fan unit is disposed adjacent to the inlet of the casing, and the fan unit is closer to the inlet of the casing than the outlet of the casing;

the duct includes a through hole that has a decreasing thickness such that a portion of the through hole of the duct directly opposed to the outlet of the fan unit has a smaller diameter than a portion of the through hole of the duct adjacent to the outlet of the casing.

2. A fan apparatus according to claim 1, wherein the inlet of the fan unit is disposed in the same position as the inlet of the casing.

3. A fan apparatus according to claim 1, wherein the duct is integral with at least one of a portion of the casing, or a portion of the fan unit.

4. A fan apparatus according to claim 1, further comprising at least one air guide member on one of the inside of the duct or the outlet of the duct.

5. A fan apparatus according to claim 4, wherein the air guide member has one of an airfoil shape or a plate shape.

6. A fan apparatus according to claim 1, wherein an opening area of a hollow portion of the duct in the outlet is larger than an opening area of a hollow portion of the duct in the inlet, when the duct is viewed from the inlet of the duct.

7. A fan apparatus according to claim 1, wherein the fan unit includes at least a first axial fan and at least a second axial fan, the first axial fan includes:

a first impeller having a plurality of first vanes and a center axis around which the first impeller can rotate;

a first motor portion arranged to rotate the first impeller;

a first base portion arranged to support the first motor portion;

a first housing defined by a hollow member having a first inlet and a first outlet, the first housing enclosing the first impeller, the first motor portion, and the first base portion; and a plurality of first supporting ribs arranged to couple the first base portion to an inner side surface of the first housing;

the second axial fan includes:

a second impeller having a plurality of second vanes arranged to rotate about the center axis;

a second motor portion arranged to rotate the second impeller;

a second base portion arranged to support the second motor portion;

a second housing defined by a hollow member having a second inlet and a second outlet, the second housing enclosing the second impeller, the second motor portion, and the second base portion; and a plurality of second supporting ribs arranged to couple the second base portion to an inner side surface of the second housing; wherein the first outlet of the first housing faces the second inlet of the second housing in a direction along the center axis, and the inlet of the fan unit is the first inlet of the first housing.

8. A fan apparatus according to claim 7, wherein a position of the first inlet of the first housing corresponds to a position of the inlet of the casing in the direction along the center axis.

9. A fan apparatus according to claim 7, wherein the first inlet of the first housing overlaps with at least a portion of the inlet of the casing when viewed from the direction along the center axis.

10. A fan apparatus according to claim 7, further comprising a duct defined as a hollow member having an inlet and an outlet, the second outlet of the second housing is the outlet of the fan unit, and the duct is arranged to couple the second outlet of the second housing to the outlet of the casing.

11. A fan apparatus according to claim 10, wherein the inlet of the duct overlaps with at least a portion of the second outlet of the second housing when viewed from the direction along the center axis.

12. A fan apparatus according to claim 10, wherein the outlet of the duct overlaps with at least a portion of the outlet of the casing when viewed from the direction along the center axis.

13. A fan apparatus according to claim 7, wherein at least a portion of an outer side surface of the first housing and at least a portion of an outer side surface of the second housing abut against at least a portion of an inner side surface of the casing.

14. A fan apparatus according to claim 7, wherein a rotating direction of the first impeller around the center axis is different from a rotating direction of the second impeller around the center axis.

15. A fan apparatus according to claim 7, wherein at least one of the first supporting ribs is opposed to at least one of the second supporting ribs in the direction along the center axis.

16. A fan apparatus according to claim 7, wherein the number of the first supporting ribs is the same as the number of the second supporting ribs.

17. A fan apparatus according to claim 7, wherein the number of the first vanes of the first impeller is different from the number of the first supporting ribs and different from the number of the second supporting ribs.

18. A fan apparatus according to claim 7, wherein the first base portion is opposed to the second base portion in the direction along the center axis.

19. A fan apparatus according to claim 7, wherein the first base portion and the first supporting ribs are arranged on the side of the first inlet of the first housing in the direction along the center axis.

20. A fan apparatus according to claim 1, wherein an axially centermost portion of the fan unit is arranged axially between the inlet of the housing and an axially centermost portion of the housing.

* * * * *